US011324650B2

(12) United States Patent
Zhou et al.

(10) Patent No.: US 11,324,650 B2
(45) Date of Patent: May 10, 2022

(54) PATIENT REPOSITIONING APPARATUS

(71) Applicant: Hill-Rom Services, Inc., Batesville, IN (US)

(72) Inventors: Jie Zhou, Batesville, IN (US); Neal Wiggermann, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 73 days.

(21) Appl. No.: 17/034,251

(22) Filed: Sep. 28, 2020

(65) Prior Publication Data

US 2021/0121346 A1 Apr. 29, 2021

Related U.S. Application Data

(60) Provisional application No. 62/925,780, filed on Oct. 25, 2019.

(51) Int. Cl.
*A61G 7/10* (2006.01)

(52) U.S. Cl.
CPC ..... *A61G 7/1032* (2013.01); *A61G 7/1073* (2013.01); *A61G 2203/10* (2013.01)

(58) Field of Classification Search
CPC .. A61G 7/0524; A61G 7/1015; A61G 7/1026; A61G 7/1032; A61G 7/1044; A61G 7/1073; A61G 7/1076; A61G 2200/32; A61G 2203/10; A61G 2203/78
See application file for complete search history.

(56) References Cited

U.S. PATENT DOCUMENTS 2,827,642 A * 3/1958 Huff ..... A61G 7/1026 5/88.1
3,597,774 A 8/1971 Warren
3,829,914 A 8/1974 Treat
4,181,992 A 1/1980 Blake
4,747,170 A * 5/1988 Knouse ..... A61G 7/1026 24/460
4,776,047 A * 10/1988 DiMatteo ..... A61G 5/006 5/81.1 C
4,918,771 A 4/1990 James
4,920,590 A 5/1990 Weiner
(Continued)

FOREIGN PATENT DOCUMENTS

WO WO-9521600 A1 * 8/1995 ..... A61G 5/1059
WO WO-0016727 A1 * 3/2000 ..... A61G 7/1057

OTHER PUBLICATIONS

Aon, 2018. Health Care Workers Compensation Barometer Actuarial Analysis, Nov. 2018. Accessed Jun. 25, 2019. https://www.aon.com/risk-services/thought-leadership/report-2018-health-care-barometer.jsp.

(Continued)

*Primary Examiner* — David R Hare
*Assistant Examiner* — Alexis Felix Lopez
(74) *Attorney, Agent, or Firm* — Barnes & Thornburg LLP

(57) ABSTRACT

A patient repositioning apparatus includes a mounting frame configured to couple to an underside of a bed frame. A motor housing is rotatably coupled to the mounting frame for rotation about an axis. The motor housing carries a motor and a winch. The motor is operable to turn the winch. A strap is coupled to the winch and configured to be wound around the winch by the motor. The strap has at least one coupling mechanism configured to couple to a bed sheet.

17 Claims, 15 Drawing Sheets

(56) References Cited

U.S. PATENT DOCUMENTS

| | | | | |
|---|---|---|---|---|
| 5,036,557 | A | 8/1991 | Fales | |
| 5,148,558 | A | 9/1992 | Dunn | |
| 5,155,874 | A | 10/1992 | Kershaw | |
| 5,168,587 | A | 12/1992 | Shutes | |
| 5,271,110 | A * | 12/1993 | Newman | A61G 7/103 5/625 |
| 5,274,862 | A | 1/1994 | Palmer et al. | |
| 5,513,406 | A | 5/1996 | Foster | |
| 5,530,974 | A | 7/1996 | Rains et al. | |
| 5,608,929 | A * | 3/1997 | Crane | A61G 7/1026 5/81.1 HS |
| 5,642,537 | A | 7/1997 | Johnson | |
| 5,659,905 | A | 8/1997 | Palmer | |
| 5,673,443 | A | 10/1997 | Marmor | |
| 6,035,465 | A | 3/2000 | Rogozinski | |
| 6,065,162 | A | 5/2000 | Behr | |
| 6,073,279 | A | 6/2000 | Skaler | |
| 6,282,734 | B1 | 9/2001 | Holberg | |
| 6,363,555 | B1 | 4/2002 | LaRose | |
| 6,393,636 | B1 | 5/2002 | Wheeler | |
| 6,484,332 | B2 | 11/2002 | Korver | |
| 6,496,991 | B1 | 12/2002 | Votel | |
| 6,523,195 | B1 | 2/2003 | Rodier et al. | |
| 6,532,607 | B1 | 3/2003 | Heil | |
| 6,560,793 | B2 | 5/2003 | Walker | |
| 6,675,412 | B2 | 1/2004 | Faucher | |
| 6,772,456 | B2 | 8/2004 | Votel | |
| 7,340,784 | B2 | 3/2008 | Stryker | |
| 7,458,113 | B2 * | 12/2008 | Milam | A61G 7/1026 254/329 |
| 7,571,498 | B2 * | 8/2009 | Jewell | A61G 7/1026 5/81.1 HS |
| 7,725,964 | B2 | 6/2010 | Minning | |
| 8,156,582 | B2 | 4/2012 | Rupar | |
| 8,710,950 | B2 * | 4/2014 | Lubbers | A61G 7/0506 340/3.71 |
| 9,693,920 | B2 | 7/2017 | Fowler et al. | |
| 2002/0083521 | A1 * | 7/2002 | Sverdlik | A61G 7/1055 5/81.1 R |
| 2003/0070226 | A1 | 4/2003 | Heimbrock | |
| 2003/0110559 | A1 | 6/2003 | Weigand | |
| 2003/0110560 | A1 | 6/2003 | Friel | |
| 2004/0221388 | A1 | 11/2004 | Votel | |
| 2005/0055769 | A1 | 3/2005 | Taylor | |
| 2005/0138727 | A1 | 6/2005 | Faux | |
| 2006/0185078 | A1 | 8/2006 | Perry | |
| 2010/0199425 | A1 | 8/2010 | Lee et al. | |
| 2010/0281613 | A1 | 11/2010 | Hillenbrand | |
| 2012/0186013 | A1 | 7/2012 | Ponsi | |
| 2012/0186587 | A1 | 7/2012 | Steffens et al. | |
| 2012/0216345 | A1 | 8/2012 | Hand | |
| 2014/0259389 | A1 | 9/2014 | Hillenbrand et al. | |
| 2014/0352058 | A1 | 12/2014 | Sverdlik | |
| 2018/0140492 | A1 * | 5/2018 | Liou | A61G 7/0524 |
| 2019/0183704 | A1 | 6/2019 | Hillenbrand, II et al. | |

OTHER PUBLICATIONS

Wiggermann, N. (2016). Biomechanical evaluation of a bed feature to assist in turning and laterally repositioning patients. Human factors, 58(5), 748-757.

Wiggermann, N. and Zhou, J (2019). Effect of Repositioning Aids and Patient Weight on Biomechanical Stresses when Repositioning Patients in Beds. Human factors.

* cited by examiner

PATIENT REPOSITIONING APPARATUS

CROSS-REFERENCE TO RELATED APPLICATIONS

This application claims priority under 35 U.S.C. § 119(e) to U.S. Provisional Patent Application Ser. No. 62/925,780, filed Oct. 25, 2019, which is expressly incorporated by reference herein.

TECHNICAL FIELD

The present disclosure relates to devices, systems, and methods for a patient support apparatus. More specifically, the present disclosure relates to devices, systems, and methods for repositioning a patient on a patient support apparatus.

BACKGROUND

Recent data indicates that patient repositioning, i.e. lateral repositioning and boosting, occurs nearly twice as frequently in a healthcare facility than transferring the patient, i.e. bed to chair transferring. High forces during patient repositioning together with the high frequency of the activities are major risks of musculoskeletal disorders on caregivers. To reduce this risk, caregivers are using different assistive bed features and repositioning aids. Most assistive features and the repositioning aids do not sufficiently mitigate the risk of injury when repositioning heavier patients. Furthermore, the extra step of applying the aids under the patient also creates a barrier to use. Mechanical lift equipment also requires applying a sling under the patient unless a Reposheet is left under the patient. However, most hospital facilities do not place the Reposheet under the patient. A draw sheet is still the standard of care. Furthermore, it is uncommon for caregivers to retrieve equipment to reposition patients.

Some products are used when boosting the patient, but are limited in that they only addresses patient boosting activity. Other activities such as lateral repositioning, turning, and lateral transferring still require a separate solution. Boosting can be physically stressful on the caregiver and can increase the risk of musculoskeletal disorders when performed manually. However; other activities, like lateral repositioning, cause even higher force relative to injury threshold. Laterally repositioning a patient is usually performed before turning the patient. Laterally repositioning patients as part of turning may pose a higher injury risk to caregivers than just turning patients due to the high pulling force. Additionally, the hand pulling force in lateral repositioning is substantially higher than in boosting.

SUMMARY

The present disclosure includes one or more of the features recited in the appended claims and/or the following features which, alone or in any combination, may comprise patentable subject matter.

According to an aspect of the disclosed embodiments, a patient repositioning apparatus may include a mounting frame configured to couple to an underside of a bed frame. A motor housing may be rotatably coupled to the mounting frame for rotation about an axis. The motor housing may carry a motor and a winch. The motor may be operable to turn the winch. A strap may be coupled to the winch and may be configured to be wound around the winch by the motor.

The strap may have at least one coupling mechanism configured to couple to a bed sheet. The motor housing may be lockable relative to the mounting frame at first and second positions that are spaced apart about the axis by about 90 degrees.

In some embodiments, in the first position, the strap may couple to a head end of a bed sheet to move a patient along a longitudinal axis of the bed frame. In the second position, the strap may couple to a side of a bed sheet to move a patient along a lateral axis of the bed frame. In the second position, the strap may couple to a side of a bed sheet to turn a patient about a longitudinal axis. The motor housing may be rotatable to a third position that is spaced apart from one of the first position about the axis by about 90 degrees and spaced apart from the second position about the axis by about 180 degrees. In the first position, the strap may extend over a head rail of the bed frame. In the second position, the strap may extend over a siderail of the bed frame.

Optionally, a control panel may operate the motor. The control panel may be operable to turn the motor on and off. The control panel may be operable to control a speed of the motor. The control panel may be configured to couple to the bed frame. The control panel may include foot pedals to control the motor. A locking mechanism may lock the motor housing into one of the first position or the second position.

It may be desired that the strap includes four coupling mechanisms. The four coupling mechanisms may be coupled to a side of the bed sheet in the second position. Two of the four coupling mechanisms may be coupled to a head of the bed sheet in the first position. The strap may include a base strap joined to the winch and a pair of end straps that interchangeably couple to the base strap. Each end strap may include at least one coupling mechanism. A first end strap of the pair of end straps may include four coupling mechanisms. A second end strap of the pair of end straps may include two coupling mechanisms.

According to another aspect of the disclosed embodiments, a patient support apparatus may include a bed frame having a top side and an underside. A mattress may be positioned on the top side. A mounting frame may be coupled to the underside of the bed frame. A motor housing may be rotatably coupled to the mounting frame for rotation about an axis between a first position and a second position. The motor housing may carry a motor and a winch. The motor may be operable to turn the winch. A strap may be coupled to the winch and configured to be wound around the winch by the motor. The strap may have at least one coupling mechanism configured to couple to a bed sheet. When the motor housing is locked in the first position the strap may extend around a head end of the bed frame and couples to a head end of the bed sheet. When the motor housing is locked in the second position the strap may extend around a side of the bed frame and couples to a side of the bed sheet.

In some embodiments, in the first position, the strap may couple to the head end of the bed sheet to move a patient along a longitudinal axis of the bed frame. In the second position, the strap may couple to the side of the bed sheet to move a patient along a lateral axis of the bed frame. In the second position, the strap may couple to the side of the bed sheet to turn a patient about a longitudinal axis. The side of the bed frame may be a first side of the bed frame and the side of the bed sheet may be a first side of the bed sheet. The motor housing may be rotatable to a third position so that the strap extends around a second side of the bed frame and couples to a second side of the bed sheet. In the first position, the strap may extend over a head rail of the bed frame. The head rail of the bed frame may include a strap guide configured to guide the strap over the head rail. The strap guide may include a groove formed in the head rail. The strap guide may include a roller coupled to the head rail. In the second position, the strap may extend over a siderail of the bed frame. The siderail of the bed frame may include a strap guide configured to guide the strap over the siderail. The strap guide may include a groove formed in the siderail. The strap guide may include a roller coupled to the siderail.

Optionally, a control panel may operate the motor. The control panel may be operable to turn the motor on and off. The control panel may be operable to control a speed of the motor. The control panel may be coupled to the bed frame. The control panel may include foot pedals to control the motor. A locking mechanism may lock the motor housing into one of the first position or the second position.

It may be contemplated that the strap includes four coupling mechanisms. The four coupling mechanisms may be coupled to the side of the bed sheet in the second position. Two of the four coupling mechanisms may be coupled to the head of the bed sheet in the first position. The strap may include a base strap joined to the winch and a pair of end straps that interchangeably couple to the base strap. Each end strap may include at least one coupling mechanism. A first end strap of the pair of end straps may include four coupling mechanisms. A second end strap of the pair of end straps may include two coupling mechanisms.

According to yet another aspect of the disclosed embodiments, a patient repositioning apparatus may include a motor housing configured to rotatably coupled to an underside of a bed frame. The motor housing may be rotatable to lock in one of a first position or a second position. The motor housing may carry a motor and a winch. The motor may be operable to turn the winch. A strap may be coupled to the winch and configured to be wound around the winch by the motor. The strap may have at least one coupling mechanism. When the motor housing is locked in the first position the strap may extend in a first direction. When the motor housing is locked in the second position the strap may extend in a second direction that is different than the first direction.

In some embodiments, the motor housing may be rotatable to lock in a third position so that the strap extends in a third direction that is different than the first direction and the second direction. In the first position, the strap may extend over a first side of the bed frame. In the second position, the strap may extend over a second side of the bed frame. In the third position, the strap may extend over a third side of the bed frame.

Optionally, a control panel may operate the motor. The control panel may be operable to turn the motor on and off. The control panel may be operable to control a speed of the motor. The control panel may be configured to couple to the bed frame. The control panel may include foot pedals to control the motor.

In some embodiments, the strap may include four coupling mechanisms. The strap may include a base strap joined to the winch and a pair of end straps that interchangeably couple to the base strap. Each end strap may include at least one coupling mechanism. A first end strap of the pair of end straps may include four coupling mechanisms. A second end strap of the pair of end straps may include two coupling mechanisms.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
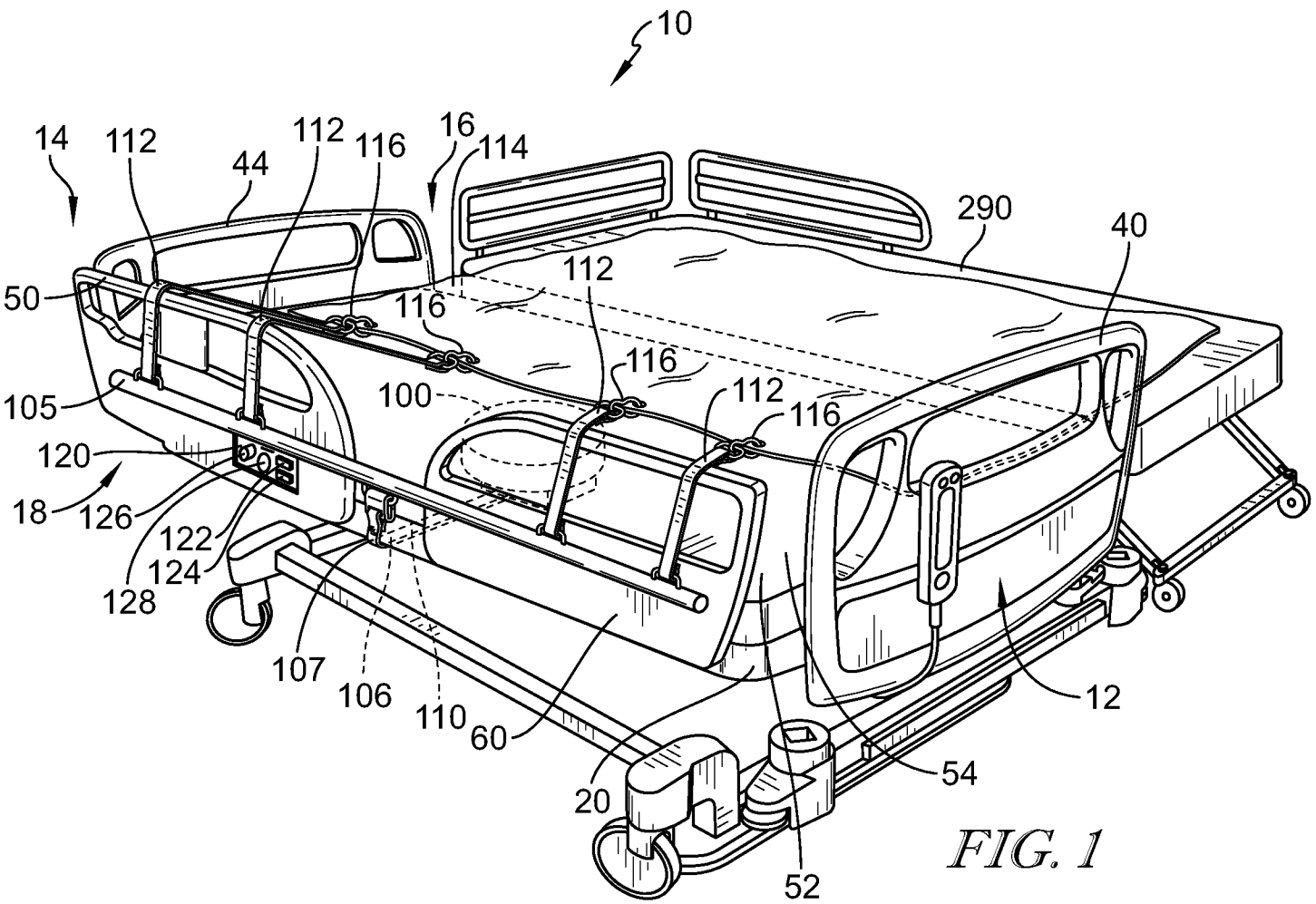
FIG. 1 is a side perspective view of a patient support apparatus having a patient repositioning apparatus coupled thereto and locked in a first position.
Figure 2:
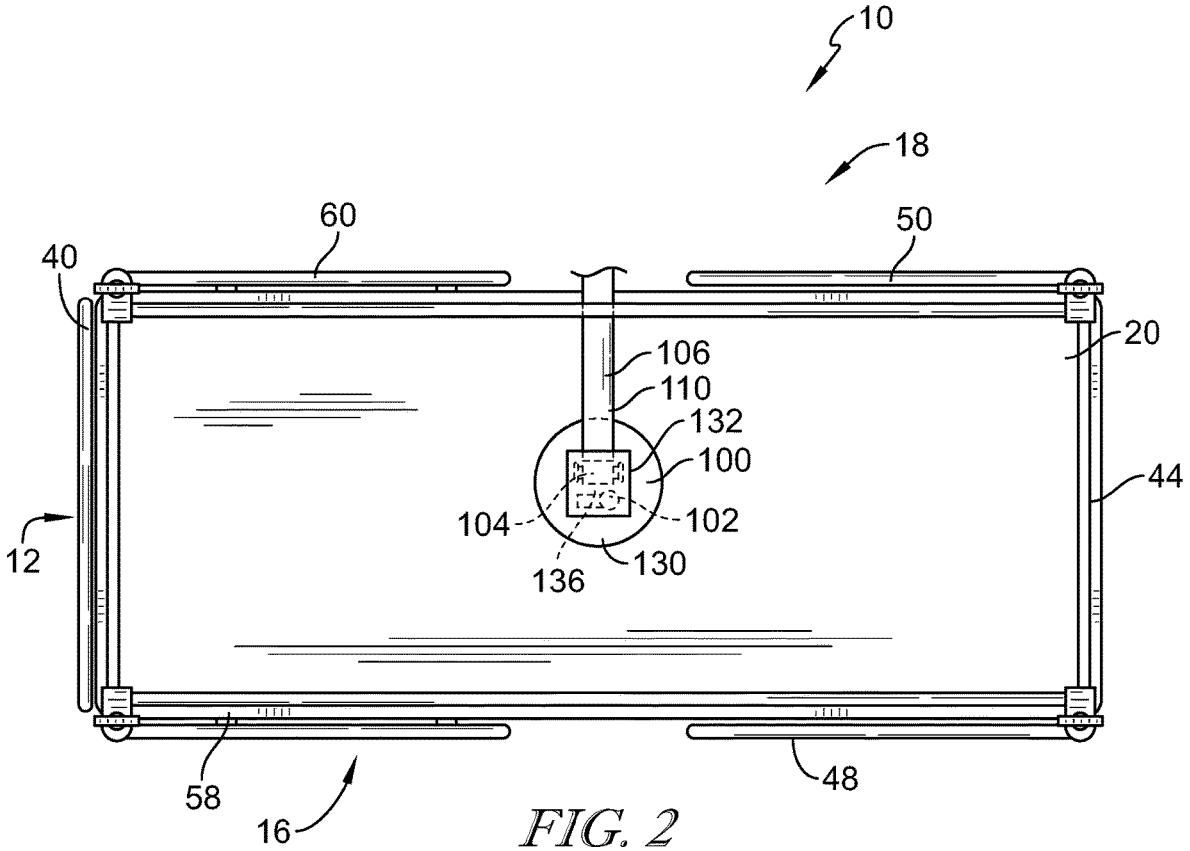
FIG. 2 is a bottom plan view of a patient support apparatus having a patient repositioning apparatus coupled thereto and locked in the first position.
Figure 3:
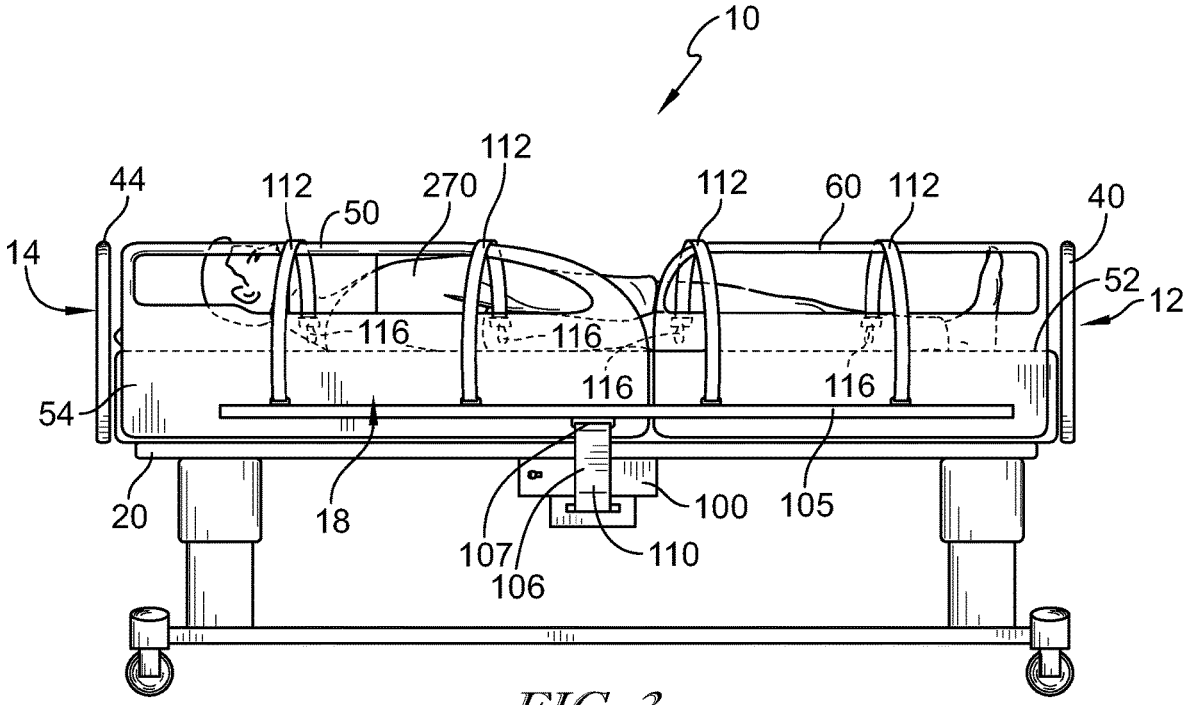
FIG. 3 is a side elevation view of a patient support apparatus having a patient repositioning apparatus coupled thereto and locked in the first position.

Referring to FIGS. 1-3, a patient support apparatus 10 is illustratively embodied as a hospital bed 10. For purposes of orientation, the discussion of the hospital bed 10 will be based on the orientation of a patient supported on the hospital bed 10 in a supine position. Thus, the foot end 12 of the hospital bed 10 refers to the end nearest the patient's feet when the patient is supported on the hospital bed 10 in the supine position. The hospital bed 10 has a head end 14 opposite the foot end 12. A left side 16 refers to the patient's left when the patient is lying in the hospital bed 10 in a supine position. The right side 18 refers to the patient's right. When reference is made to the longitudinal length of the hospital bed 10, it refers to a direction that is represented by the lines that generally extend between the head end 14 and foot end 12 of the hospital bed 10. Similarly, lateral width of the hospital bed 10 refers to a direction that is represented by the lines that generally extend between the left side 16 and right side 18. The hospital bed 10 includes a frame 20, which supports a mattress 54. The mattress 54 extends from the head end 14 to the foot 12 between the left side 16 and the right side 18.

A foot panel 40 is supported from the frame 20 and extends vertically to form a barrier at the foot end 12 of the hospital bed 10. A head panel 44 is positioned on the frame 20 and extends vertically to form a barrier at the head end 14 of the hospital bed 10. A left head siderail 48 is moveable between a raised position and a lowered position as is known in the art. A right head siderail 50 is also moveable between the raised position of FIG. 1 and a lowered position. As shown in FIG. 1, in the raised position, the siderails 48 and 50 extend above an upper surface 52 of a mattress 54 of the hospital bed 10 when the siderails 48 and 50 are in a raised position. It should be appreciated that in some embodiments, the left head siderail 48 and the right head siderail 50 are movable to and lockable in one or more positions between the raised position and the lowered position.

The hospital bed 10 also includes a left foot siderail 58 and a right foot siderail 60, each of which is supported directly from the frame 20. Each of the siderails 48, 50, 58, and 60 are operable to be lowered to a position below the upper surface 52. It should be appreciated that in some embodiments, the left foot siderail 58 and the right foot siderail 60 are movable to a position between the raised position and the lowered position.

A frame 20 of the bed 10 includes a base frame 21 and an upper frame 23. The upper frame 23 raises, lowers, and tilts relative to the base frame 21. A patient repositioning apparatus 100 is coupled to an underside of the upper frame 23 of the hospital bed 10. The patient repositioning apparatus 100 may be permanently fixed to the upper frame 23 in some embodiments. In other embodiments, the apparatus 100 is retro fit onto an existing hospital bed 10 and retained on the bed 10 throughout a life span of the bed 10. In yet other embodiments, the apparatus 100 may be installed by a caregiver when the apparatus 100 is needed to reposition a patient. The apparatus 100 includes a motor 102 that drives a winch 104. A strap 106 is configured to be wound around the winch 104. The motor 102 is configured to drive the winch 104 to wind the strap 106 around the winch 104 and pull the strap 106 into the apparatus 100.

As illustrated in FIGS. 1-3, the apparatus 100 is positioned so that the strap 106 extends in a first direction toward the right side 18 of the bed 10. The strap 106 includes a base strap 110 that winds around the winch 104. A bar 105 is attached to an end 107 of the base strap 110. Four end straps 112 extend from the bar 105. The four end straps 112 include coupling mechanisms 116 that are configured to couple to a side 144 of a bed sheet 114 on the bed 10. In the orientation shown in FIG. 1, the four end straps 112 extend over the right head siderail 50 and the right foot siderail 60 to couple to the bed sheet 114. Once the coupling mechanisms 116 are coupled to the bed sheet 114 the winch 104 is operated to draw the strap 106 inward. The bar 105 pulls evenly on the four end straps 112 to pull the bed sheet 114 toward the right side 18 of the bed 10 to laterally reposition a patient on the bed 10.

A control panel 120 is coupled to the right head siderail 50 and is configured to control the operation of the apparatus 100. The control panel 120 includes an extend button 122 and a retract button 124. The extend button 122 winds the winch 104 in a first rotational direction to loosen the strap 106 so that the strap 106 can be pulled out of the apparatus 100 and coupled to the bed sheet 114. The retract button 124 winds the winch 104 in an opposite rotational direction to wind the strap 106 around the winch 104 and pull the strap 106 into the apparatus 100. It should be noted that the strap 106 is also retractable for storage. A speed dial 126 is provided to control a speed of the motor 102 and subsequently a speed at which the winch 104 draws in the strap 106. An emergency stop button 128 is provide to stop operation of the apparatus 100.

Referring now to FIG. 2, the apparatus 100 includes a mounting frame 130 that is coupled to the upper frame 23. The mounting frame 130 is rotatable about an axis 136 between a plurality of positions, as described in more detail below. For example, the mounting frame 130 may be configured to rotate 360 degrees. A motor housing 132 is coupled to the mounting frame 130 and configured to rotate with the mounting frame 130. The motor housing 132 carries the motor 102 and the winch 104. The motor 102 is electrically coupled to the winch 104 to drive the winch 104. The strap 106 extends from the winch 104 and out of the motor housing 132. In the illustrative embodiment, the motor housing 132 is locked in a first position so that the strap 106 extends in the first direction toward the right side 18 of the bed 10. The control panel 120 is electrically coupled to the motor 102 to control the motor 102.

Figure 4:
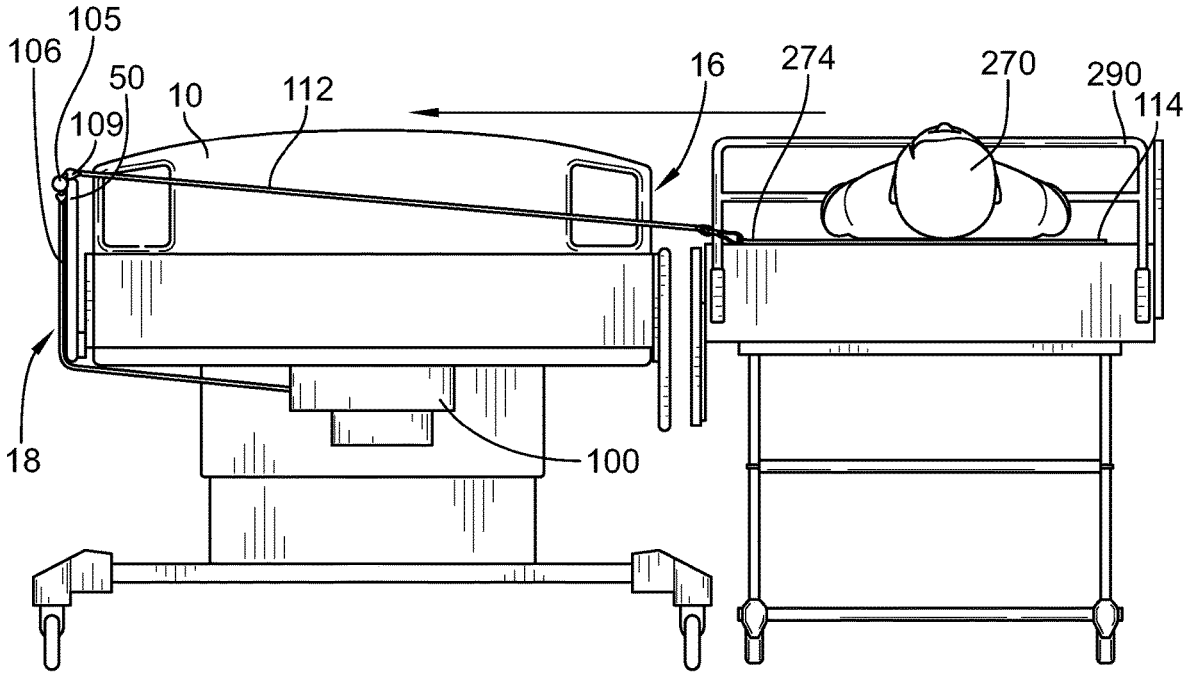
FIG. 4 is front elevation view of a patient in a first position being transferred to the patient support apparatus from a second patient support apparatus with the patient repositioning apparatus.

The apparatus 100 enables a patient 270 to be transferred from a patient support apparatus 290, i.e. a stretcher or gurney, to the bed 10. In the illustrative embodiment, the apparatus 290 is positioned on the left side 16 of the bed 10 with the patient 270 thereon. As illustrated in FIG. 4, the patient 270 is positioned on the bed sheet 114 on the apparatus 290. The strap 106 is extended from the right side 18 of the bed 10 and wrapped around the bed 10. The end straps 112 are secured to the right side 274 of the bed sheet 114. In this position, the bar 105 is positioned at a top 109 of the right head siderail 50 and the right foot siderail 60.

Figure 5:
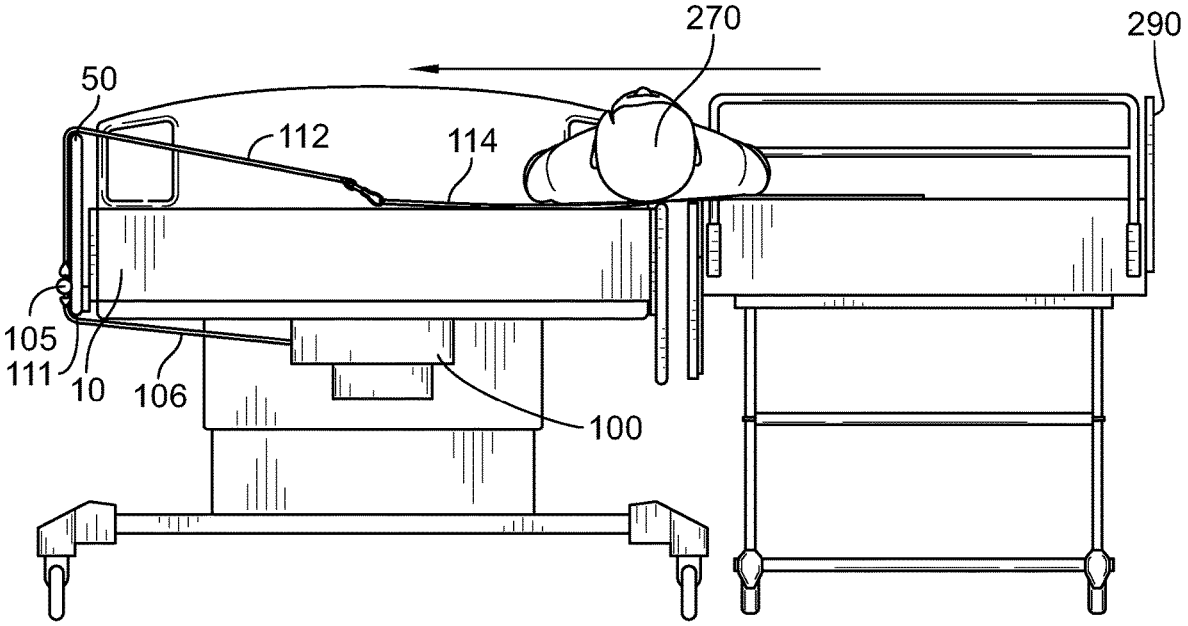
FIG. 5 is front elevation view of a patient in a second position being transferred to the patient support apparatus from a second patient support apparatus with the patient repositioning apparatus.
Figure 6:
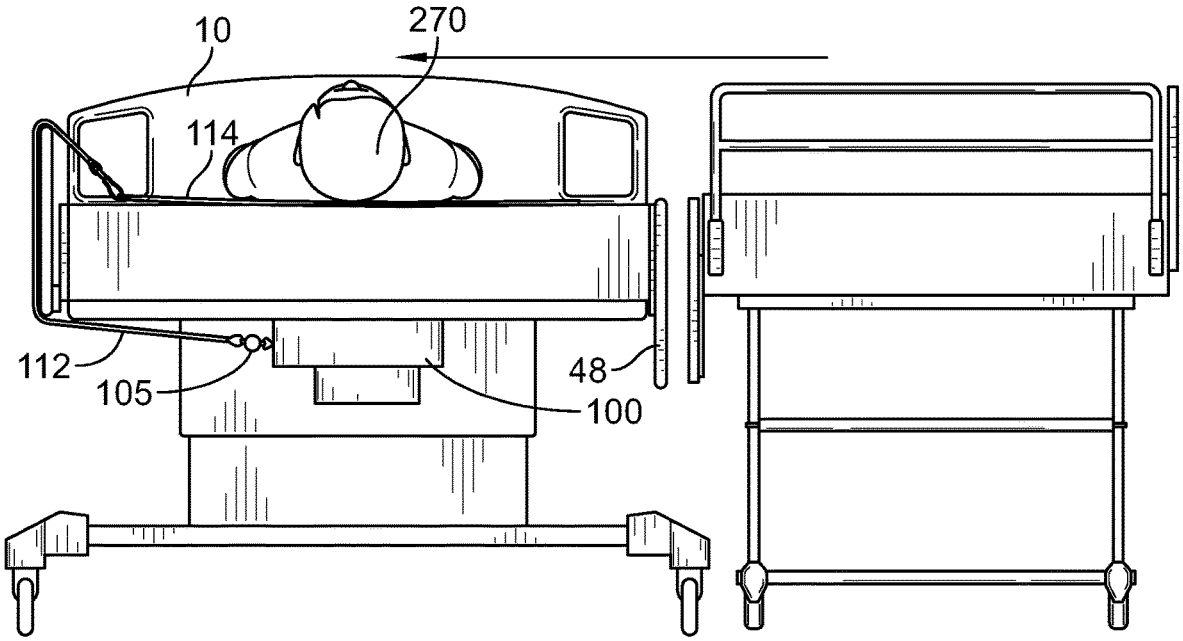
FIG. 6 is front elevation view of a patient in a third position being transferred to the patient support apparatus from a second patient support apparatus with the patient repositioning apparatus.

As shown in FIG. 5, the winch 104 is operated to transfer the bed sheet 114, and the patient 270, from the apparatus 290 onto the bed 10. FIG. 5 illustrates the patient 270 half way between the bed 10 and the apparatus 290. In this position, the bar 105 is positioned at a bottom 111 of the right head siderail 50 and the right foot siderail 60. FIG. 6 illustrates the patient 270 fully pulled onto the bed 10. In this position, the bar 105 is positioned adjacent the apparatus 100.

Although FIGS. 4-6 illustrate the apparatus 290 on the left side 16 of the bed 10, it will be appreciated that the apparatus 290 may be positioned on the right side 18 of the bed 10. In this orientation, the strap 106 is extended from the left side 16 of the bed 10 and wrapped around the bed 10. The end straps 112 are secured to the left side 272 of the bed sheet 114. The winch 104 is operated to transfer the bed sheet 114, and the patient 270, from the apparatus 290 onto the bed 10. It will be appreciated that either of the straps 106 or 230 may be used to transfer the patient.

Figure 7:
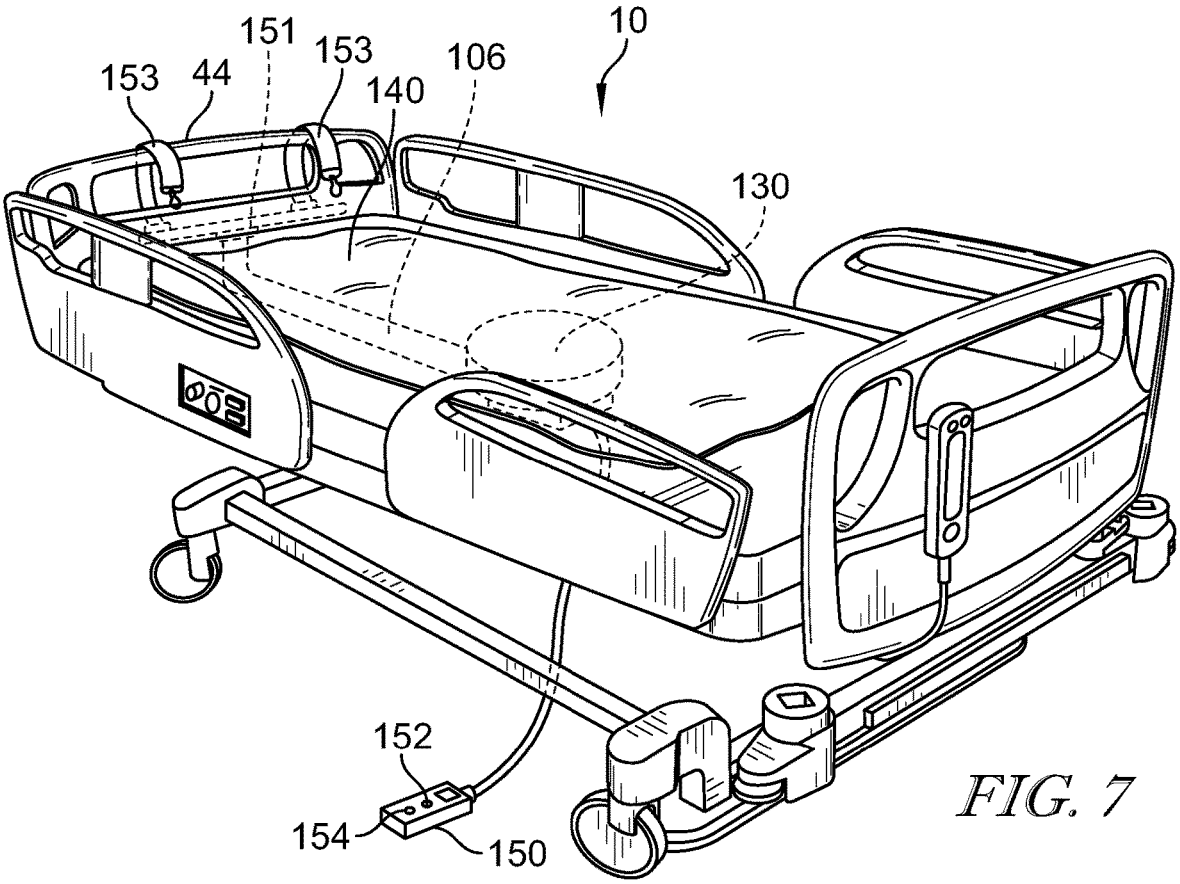
FIG. 7 is a side perspective view of a patient support apparatus having a patient repositioning apparatus coupled thereto and locked in a second position.
Figure 8:
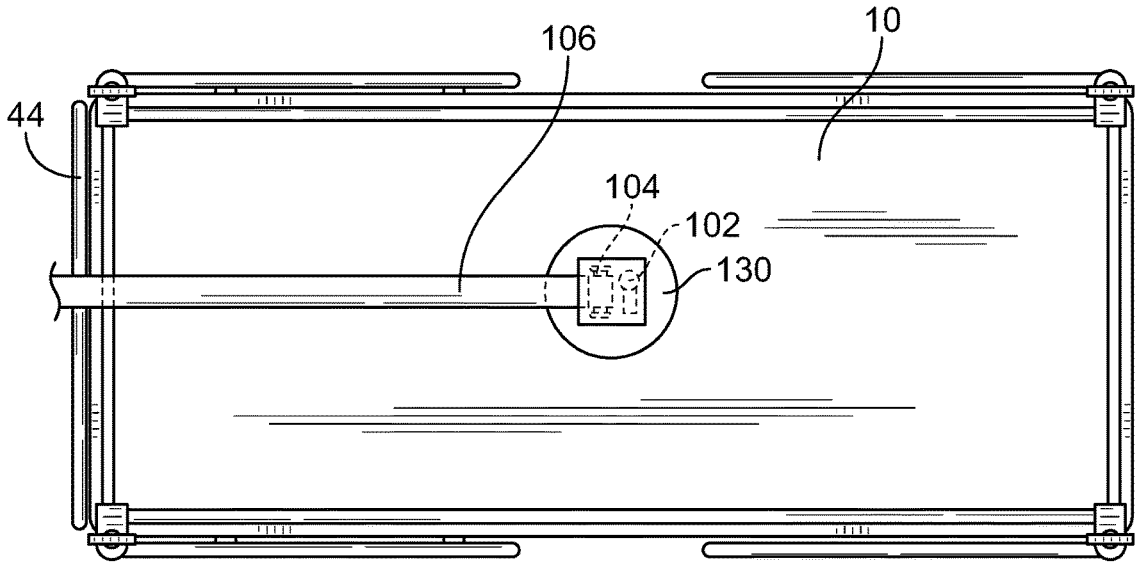
FIG. 8 is a bottom plan view of a patient support apparatus having a patient repositioning apparatus coupled thereto and locked in the second position.
Figure 9:
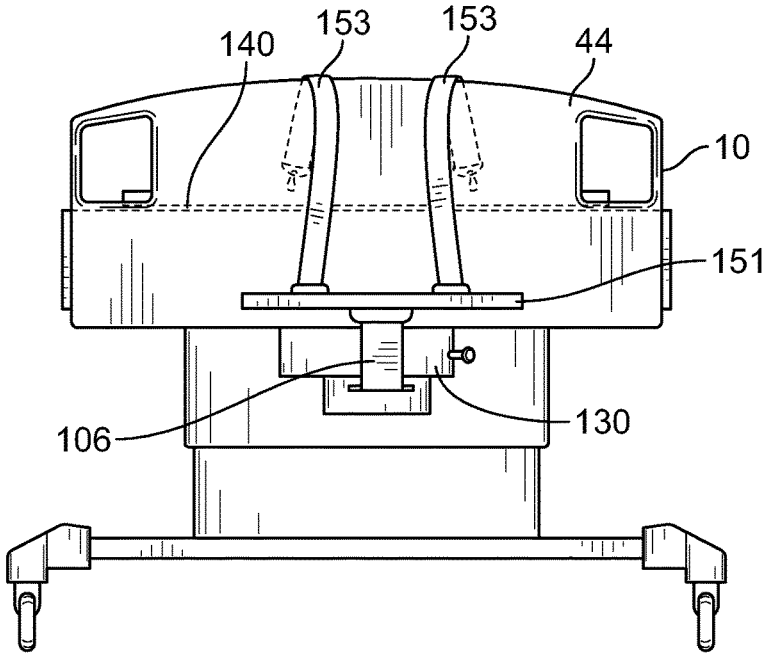
FIG. 9 is a front elevation view of a patient support apparatus having a patient repositioning apparatus coupled thereto and locked in the second position.

As illustrated in FIGS. 7-9, the mounting frame 130 is rotatable to lock in a second position. In the second position, the strap 106 extends in a second direction. The second direction is approximately 90 degrees from the first direction. When extending in the second direction, the strap 106 is configured to wrap around the head panel 44 of the bed 10. In such a configuration, another bar 151 is coupled to the strap 106. Two end straps 153 extend from the bar 151 and are configured to couple to the head end 140 of the bed sheet 114, as shown in FIG. 7. The motor 102 is actuated to turn the winch 104 and draw the bed sheet 114 toward the head panel 44 to move the patient longitudinally on the bed 10. This motion is sometimes referred to as "pull up in bed" in the art.

In the embodiment shown in FIG. 7, the apparatus 100 includes a foot control 150. The foot control 150 includes an extend pedal 152 and a retract pedal 154. The extend pedal 152 is actuated to turn the winch in a rotational direction that extends the strap 106 so that the strap 106 can be coupled to the bed sheet 114. The retract pedal 154 is actuated to wind the winch 106 in a rotational direction that winds the strap 106 around the winch 104 to retract the strap 106 and pull the bed sheet 114. It should be noted that the strap 106 is also retractable for storage. An emergency stop button 155 stops movement of the winch 104 when activated.

Figure 10:
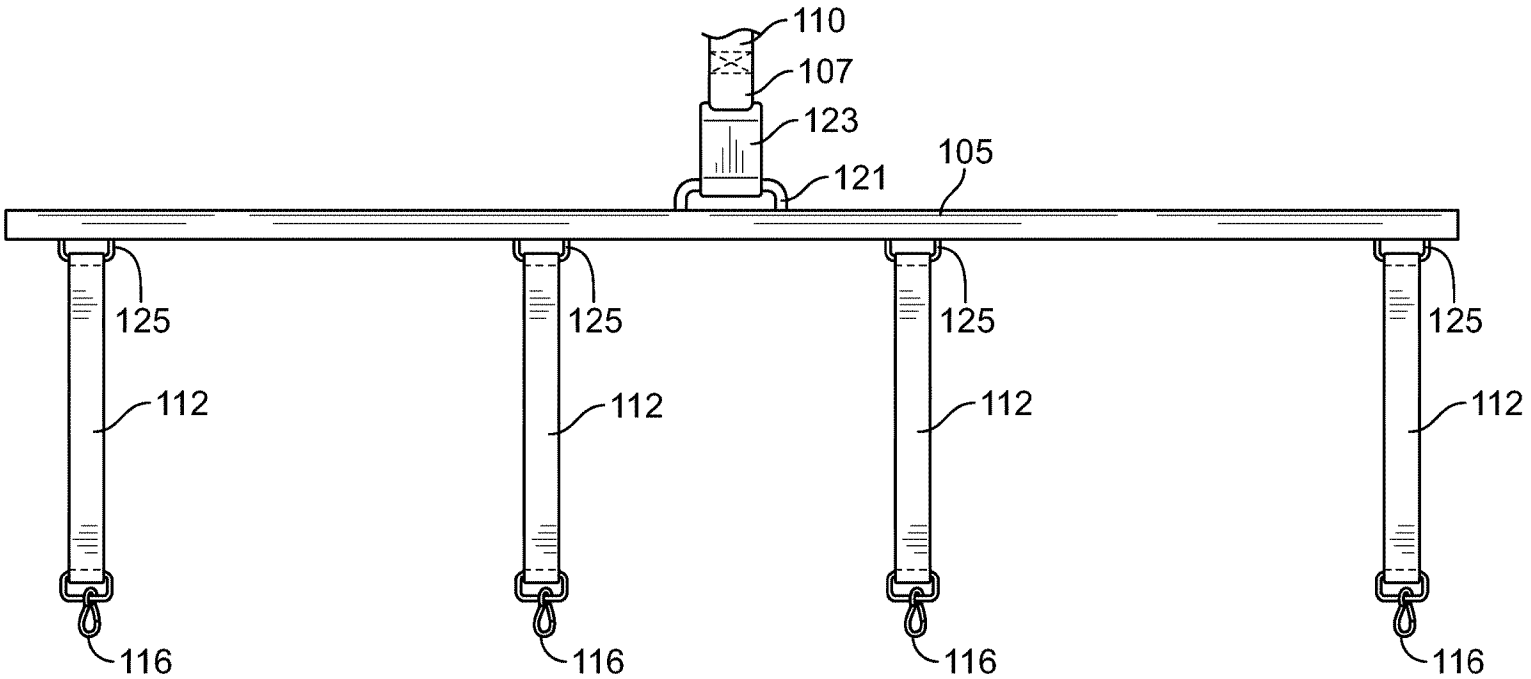
FIG. 10 is a top perspective view of an embodiment of the strap of the patient repositioning apparatus.
Figure 11:
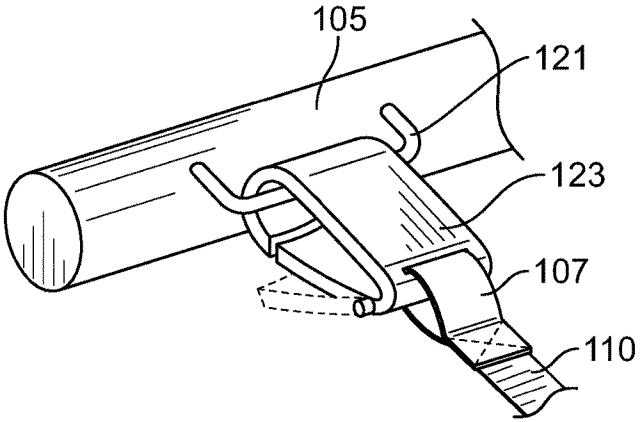
FIG. 11 is an expanded perspective view of a coupling mechanism attached to a grommet of the sheet.
Figure 13:
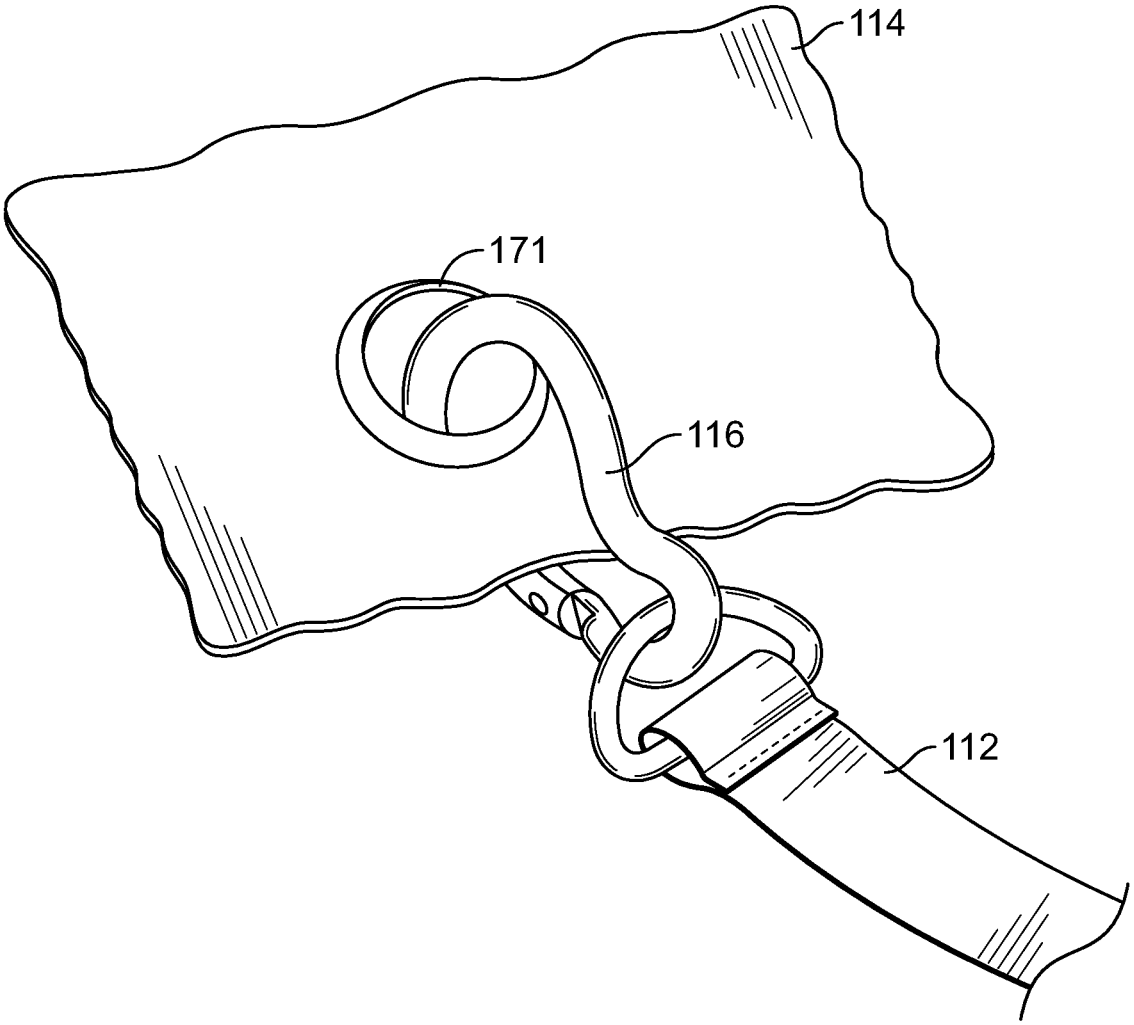
FIG. 13 is a top perspective view of the strap being attached to a grommet in the sheet.

Referring now to FIGS. 10 and 11, the bar 105 includes a U-shaped handle or bail 121 that extends from the bar 105. The handle 121 couples to a fastener 123 positioned at the end 107 of the base strap 110. Additional handles or bails 125 couple to the end straps 112 to couple the end straps 112 to the bar 105. The coupling mechanisms 116 secure to a respective grommet 171 provided in the sheet 114, as shown in FIG. 13. The bed sheet 114 may include grommets 171 on any side of the sheet 114 including the right side 274, the left side 272, the head end 140, or the foot end 276.

Figure 12:
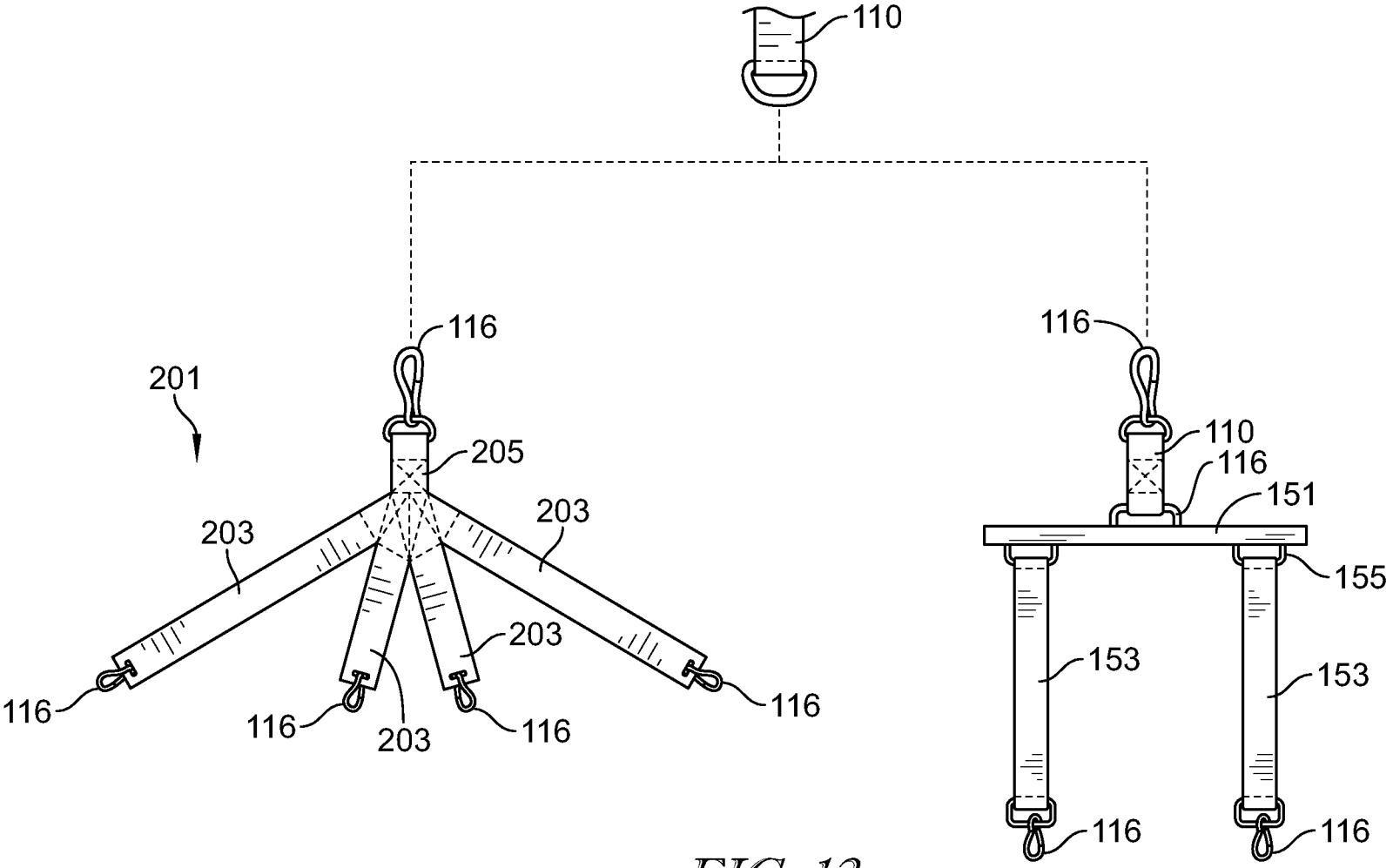
FIG. 12 is a top perspective view of another embodiment of straps for the patient reposition apparatus.
Figure 14:
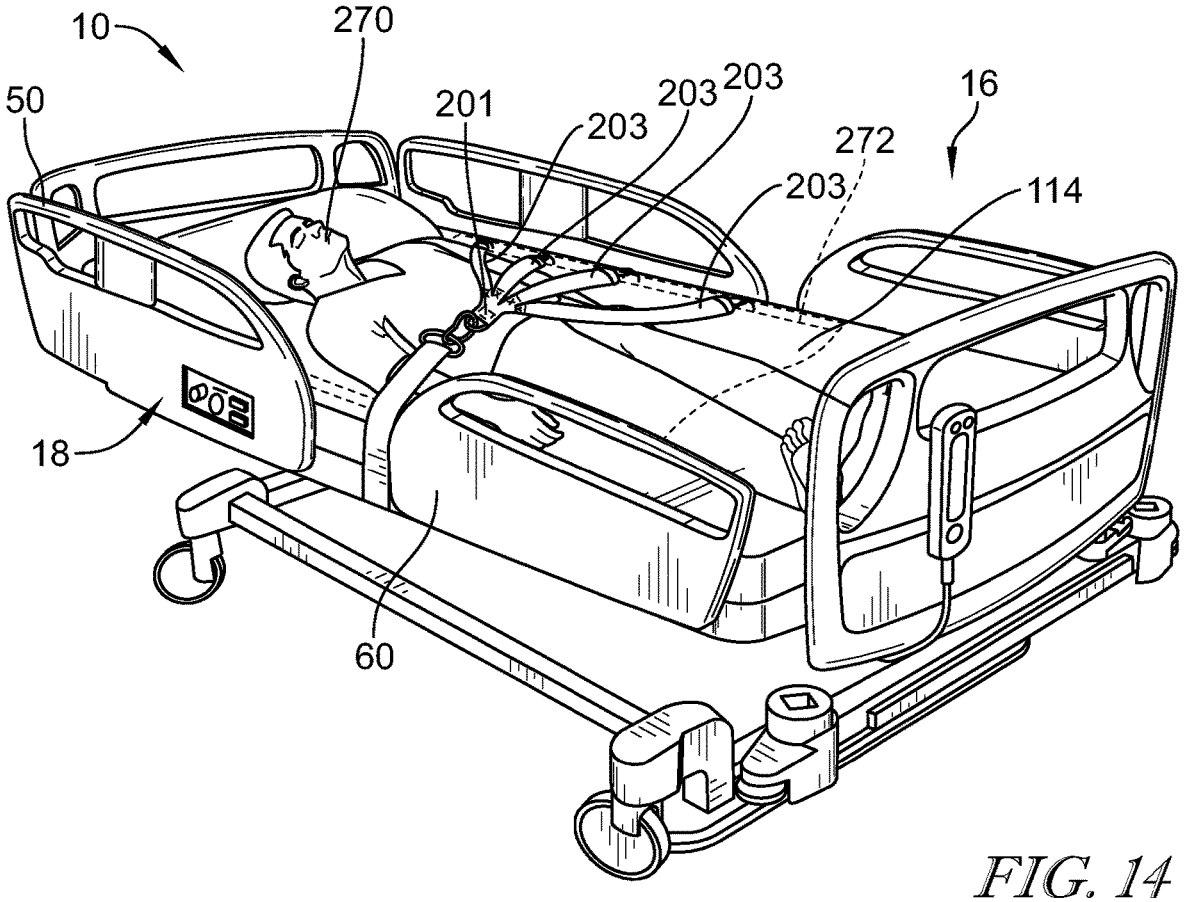
FIG. 14 is top perspective view of a patient being turned on a patient support apparatus with the patient repositioning apparatus.

FIG. 12 illustrates another embodiment of a strap 201, wherein the strap 201 includes four end straps 203 angled from a base strap 205. The end straps 203 are integrally formed with the base strap 205. In such an embodiment, any number of the end straps 203 may be utilized to secure to the bed sheet 114. For example, to move a child, the user may only utilize two or three of the end straps 203. FIG. 14 illustrates a configuration of the apparatus 100 that uses the strap 201 to turn a patient 270 while in bed. In this configuration, the end straps 203 are extended from the right side 18 of the bed 10 and over the patient 270 to the left side 16 of the bed 10. The end straps 203 are secured to a left side 272 of the bed sheet 114. By operating the winch 104, the end straps 203 pull the left side 272 of the bed sheet 114 to turn the patient 270 toward the right side 18 of the bed 10. In one embodiment, the end straps 203 are wrapped over the siderails 50, 60 to prevent the end straps 203 from rubbing against the patient 270.

In the orientation shown in FIG. 14, the end straps 203 are secured to the left side 272 of the bed sheet 114. It will be appreciated that, while FIG. 14 illustrates the end straps 203 secured to the left side 272 of the bed sheet 114, the end straps 203 may be secured to the right side 274 of the bed sheet 114 to turn the patient toward the left side 16 of the bed 10.

Referring back to FIG. 12, the bar 151 also includes a U-shaped handle or bail 116 to couple to the base strap 110. Handles 155 couple to the end straps 153. The coupling mechanisms 116 are configured to attach to the grommets 117 of the bed sheet 114.

Figure 15:
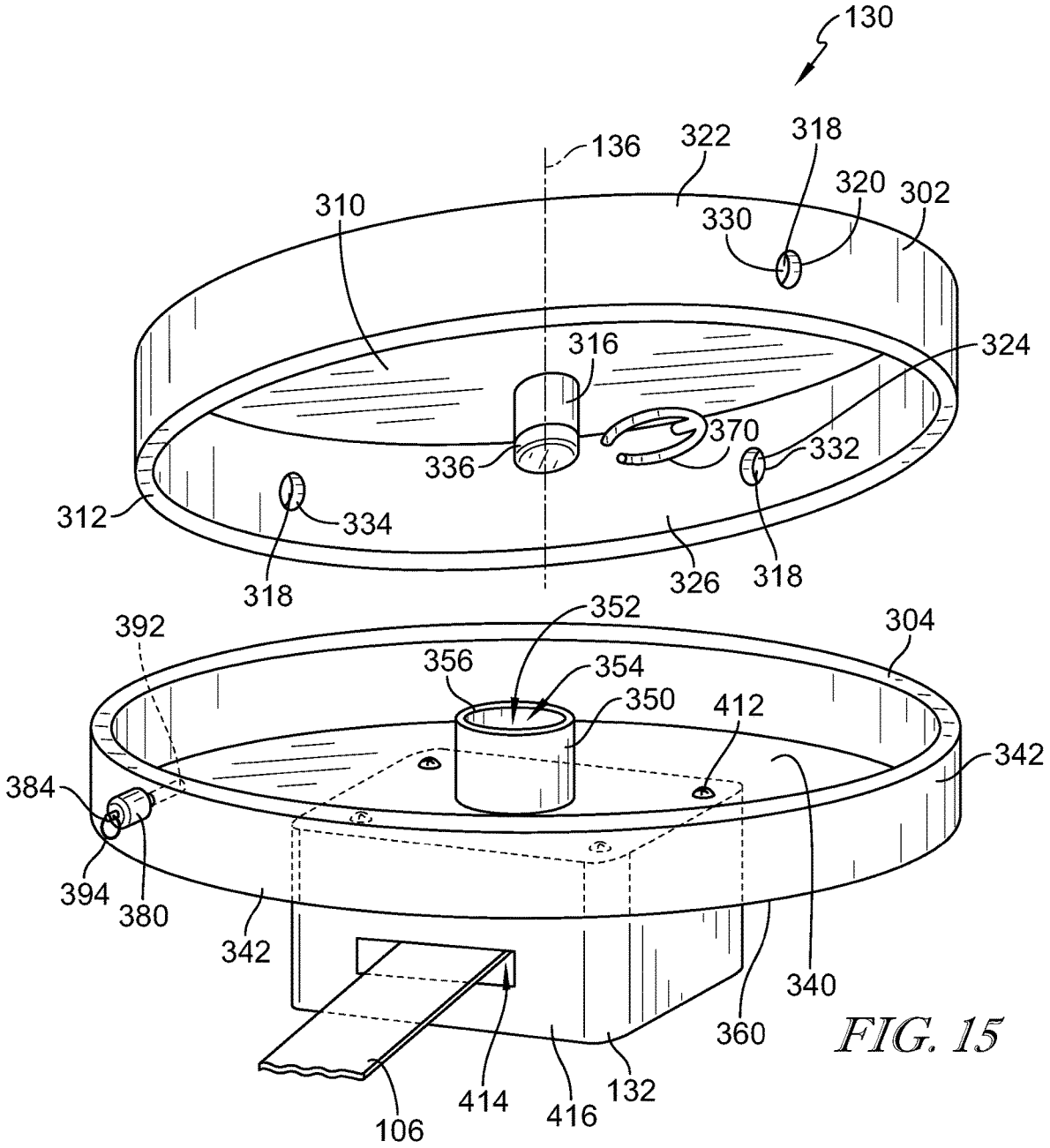
FIG. 15 is an exploded side perspective view of the patient repositioning apparatus.
Figure 16:
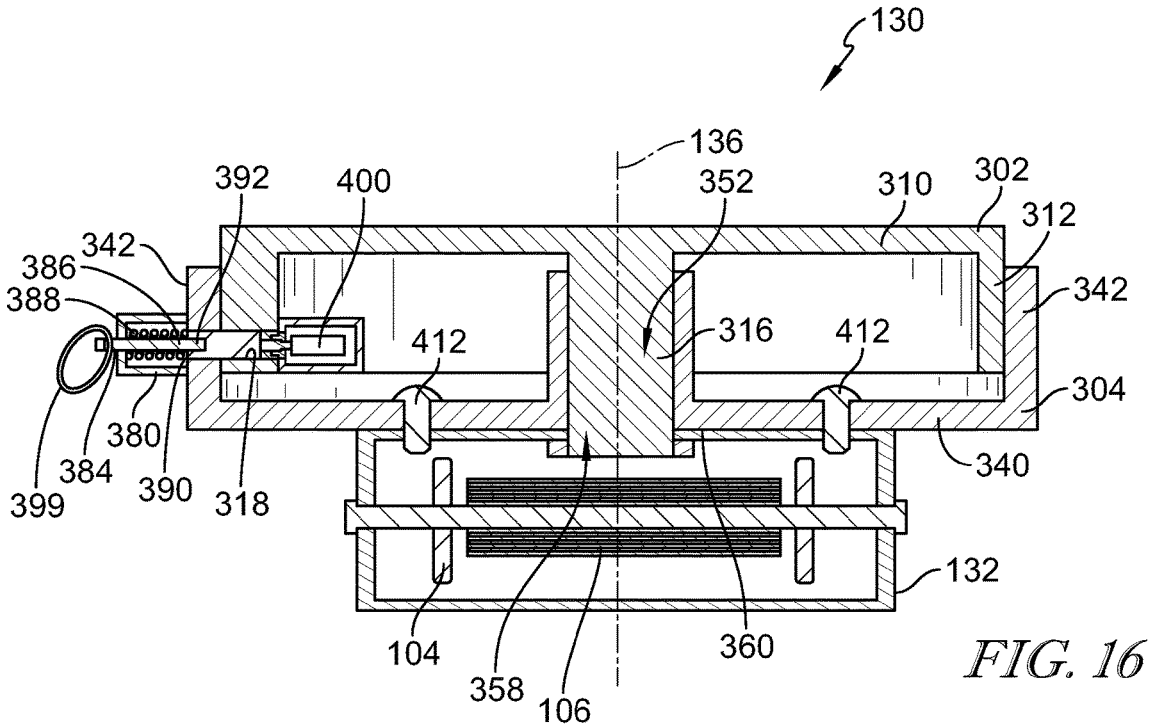
FIG. 16 is a side cross-sectional view of the patient repositioning apparatus.

Referring to FIGS. 15 and 16, the mounting frame 130 is configured to attach to the underside of the upper frame 23 of the bed 10. The mounting frame 130 includes a base frame 302 and a rotating frame 304. The base frame 302 is coupled to the upper frame 23 of the bed 10 with suitable fasteners, such as bolts (not shown), and the rotating frame 304 couples to the base frame 302. The rotating frame 304 is configured to rotate about the axis 136 relative to the base frame 302. For example, the rotating frame 304 may rotate 360 degrees about the axis 136 relative to the base frame 302. In other embodiments, the range of rotation of the rotating frame 304 may be limited.

The base frame 302 includes a main body 310, which is illustrated as being circular. A flange 312 extends downward from an outer circumference of the main body 310. A center post 316 is centered in the main body 310 and extends downward from the main body 310. The post 316 includes a notch or groove 336 that extends circumferentially around the post 316. The flange 312 includes a plurality of apertures 318 extending from an opening 320 in an outer surface 322 of the flange 312 to an opening 324 in an inner surface 326 of the flange 312. A first aperture 330 is spaced approximately 90 degrees from a second aperture 332. A third aperture 334 is spaced approximately 90 degrees from the second aperture 332 and 180 degrees from the first aperture 330. In some embodiments, a fourth aperture (not shown) is positioned 90 degrees from the third aperture 334 and the first aperture 330, and 180 degrees from the second aperture 332.

The rotating frame 304 includes a main body 340 that is circular and a flange 342 that extends upward from the main body 340 from an outer circumference of the main body 340. A post 350 extends upward from a center of the main body 340. The post 350 includes an aperture 352 extending into the post 350 from an opening 354 in a top 356 of the post 350 to an opening 358 formed in a bottom 360 of the main body 340. The aperture 352 receives the post 316 so that the post 316 extends outward from the opening 358 formed in the bottom 360 of the main body 340. A clip 370 is secured into the notch 336 on the post 316 to hold the rotating frame 304 to the base frame 302. It should be noted that the rotating frame 304 may be coupled to the base frame 302 using other fastening mechanisms, in some embodiments. When the rotating frame 304 is secured to the base frame 302, the flange 342 of the rotating frame 304 is positioned outside of the flange 312 of the base frame 302 so that the flange 312 of the base frame 302 nests within the flange 342 of the rotating frame 304.

A pull pin housing 380 extends from the outer circumference of the flange 342 of the rotating frame 304. A pull pin 384 extends through the pull pin housing 380 and through the flange 342. The pull pin 384 includes a shoulder 386, as shown in FIG. 16. A spring 388 is positioned between the shoulder 386 and an outer wall 390 of the pull pin housing 380. The spring 388 biases the pull pin 384 toward the axis 136. When the rotating frame 304 is coupled to the base frame 302, an end 392 of the pull pin 384 extends through one of the apertures 318 to lock the rotating frame 304 in a rotational position relative to the base frame 302. A user may pull a ring or knob 394 of the pull pin 384 to remove the end 392 of the pull pin 384 from the aperture 318 and unlock the rotating frame 304 from the base frame 302. In this way, the rotating frame 304 may be rotated about the axis 136 and the pull pin 384 may be secured in another aperture 318.

In the illustrative embodiment, a respective limit switch 400 is positioned at each of the openings 324 in the inner surface 326 of the flange 312. When the pull pin 384 is secured in one of the apertures 318, the end 392 of the pull pin 384 engages the respective limit switch 400. If one of the limit switches 400 is engaged, the motor 102 becomes operable because the rotating frame 304 is secured to the base frame 302. If none of the limit switches 400 are engaged, the motor 102 is inoperable because the rotating frame 304 is not secured to the base frame 302. Thus, the limit switches 400 prevent the motor 102 from being operated when the rotating frame 304 is still capable of being rotated about the axis 136.

The motor housing 132 is secured to the bottom 360 of the main body 340 of the rotating frame 304. The motor housing 132 is illustrated as being bolted to the rotating frame 304 with bolts 412; however, the motor housing 132 may be secured to the rotating frame 304 using any suitable fastening mechanism. The motor housing 132 carries the motor 102 and the winch 104. The strap 106 extends from an opening 414 formed in a side 416 of the motor housing 132.

Figure 17:
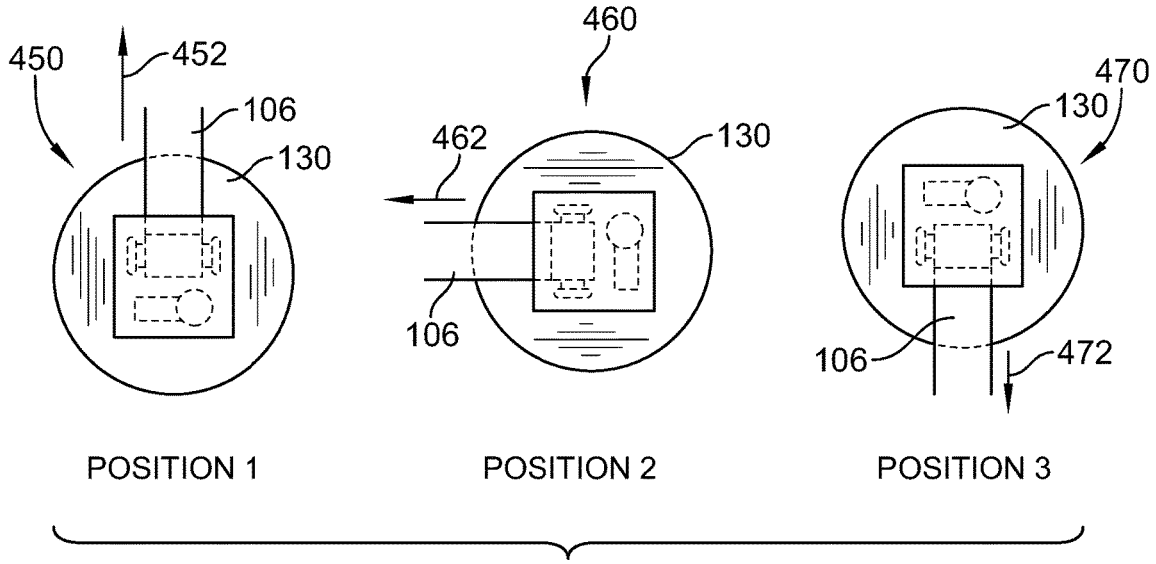
FIG. 17 is a bottom plan view of three distinct locking positions of the patient repositioning apparatus.

FIG. 17 illustrates three locked positions of the mounting frame 130. The mounting frame 130 locks into one of these three positions when the pull pin 384 is secured into one of the apertures 318. In a first position 450, the strap 106 extends in a first direction 452. For example, in the first position 450 that strap 106 may extend toward the left side 16 of the bed 10. In a second position 460, the strap 106 extends in a second direction 462 that is 90 degrees relative to the axis 136 from the first direction 452. For example, in the second position 460, the strap 106 may extend toward the head end 14 of the bed 10. In a third position 470, the strap 106 extends in a third direction 472 that is 90 degrees from the second direction 462 and 180 degrees from the first direction 452 relative to the axis 136. For example, in the third position 470, the strap 106 may extends toward a right side 18 of the bed 10.

It will be appreciated that the mounting frame 130 may also be rotatable to a fourth position (not shown), wherein the strap 106 extends in a fourth direction (not shown). The fourth direction may be 90 degrees from the third direction 472 and 180 degrees from the second direction 462 relative to the axis 136. For example, in the fourth position, the strap 106 may extend to the foot end 12 of the bed 10. It will also be appreciated that in some embodiments, the mounting frame 130 may be locked in other positions located between the first position 450, the second position 460, and the third position 470. In such embodiments, the strap 106 extends in other directions between the first direction 452, the second direction 462, and the third direction 472.

Figure 18:
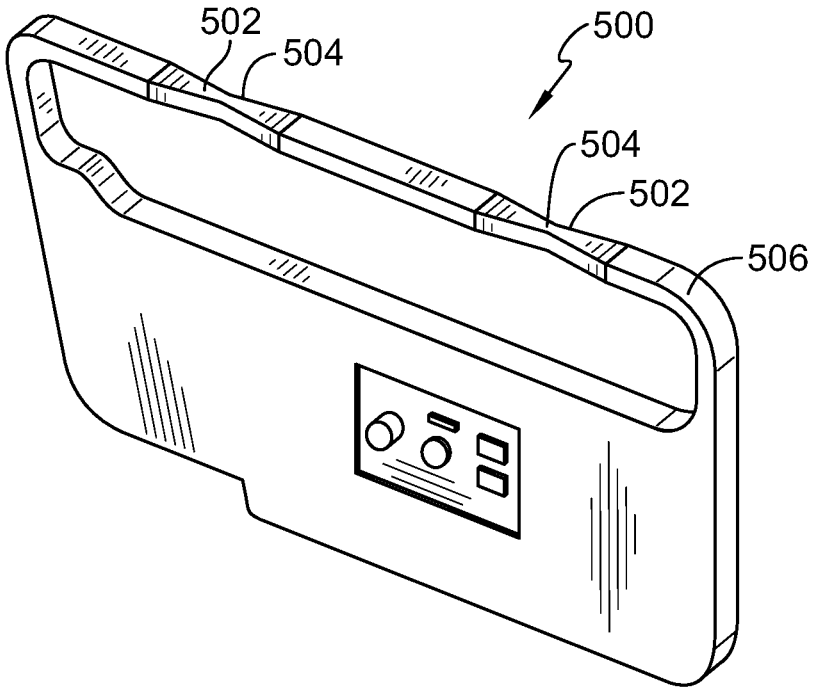
FIG. 18 is a top plan view of an embodiment of a rail that may be used with the patient support apparatus.

Referring now to FIG. 18, an exemplary barrier 500 may be a siderail 48, 58, 50, or 60, a foot panel 40, or a head panel 44. The barrier 500 includes grooves 502 that define indents 504 in a top 506 of the barrier 500. The grooves 502 are configured to receive the straps 112 or 153. That is, when the straps 112 or 153 are wrapped around the barrier 500, the straps 112 or 153 are positioned in the grooves 502. The grooves 502 guide the straps 112 or 153, as the straps 112 or 153 are pulled by the winch 104 to prevent friction along the top 506 of the barrier 500.

Figure 19:
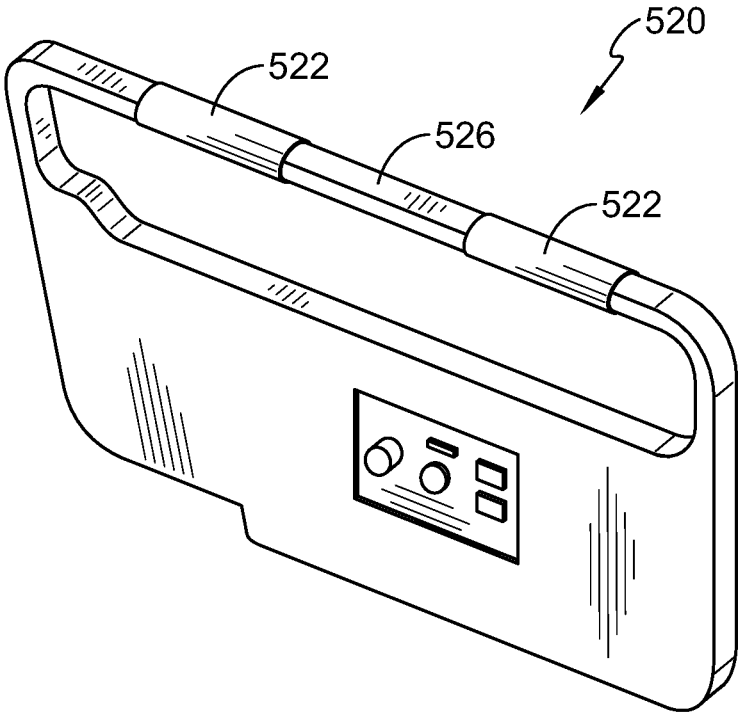
FIG. 19 is a top plan view of an embodiment of another rail that may be used with the patient support apparatus.

Referring to FIG. 19, an exemplary barrier 520 may be a siderail 48, 58, 50, or 60, a foot panel 40, or a head panel 44. The barrier 520 includes rollers 522 that roll relative to a top 526 of the barrier 520. The rollers 522 are configured to receive the straps 112 or 153. That is, when the straps 112 or 153 are wrapped around the barrier 520, the straps 112 or 153 are positioned in the rollers 522. The rollers 522 guide the straps 112 or 153, as the straps 112 or 153 are pulled by the winch 104 to prevent friction along the top 526 of the barrier 500.

In some embodiments, the apparatus 100 can communicate with the bed 10. Accordingly, the patient repositioning and mobilizing history is recorded and used for further data analysis. For example, information can be obtained about when the patient is moved, what type of movement it is, etc. This enables an understanding of the compliance of the caregivers to a safe patient handling protocol, and the benefits of mobilizing patient, i.e. if mobilizing patient has helped reducing the patient length of stay.

Although this disclosure refers to specific embodiments, it will be understood by those skilled in the art that various changes in form and detail may be made without departing from the subject matter set forth in the accompanying claims.

The invention claimed is:

1. A patient repositioning apparatus comprising:

a mounting frame configured to couple to an underside of a bed frame, a motor housing rotatably coupled to the mounting frame for rotation about an axis, the motor housing carrying a motor and a winch, wherein the motor is operable to turn the winch, and a strap coupled to the winch and configured to be wound around the winch by the motor, the strap having at least one coupling mechanism configured to couple to a bed sheet, wherein the motor housing is lockable relative to the mounting frame at first and second positions that are spaced apart about the axis by about 90 degrees.

2. The apparatus of claim 1, wherein, in the first position, the strap couples to a head end of the bed sheet to move a patient along a longitudinal axis of the bed frame.

3. The apparatus of claim 1, wherein, in the second position, the strap couples to a side of the bed sheet to move a patient along a lateral axis of the bed frame.

4. The apparatus of claim 1, wherein, in the second position, the strap couples to a side of the bed sheet to turn a patient about a longitudinal axis.

5. The apparatus of claim 1, wherein the motor housing is rotatable to a third position that is spaced apart from one of the first position about the axis by about 90 degrees and spaced apart from the second position about the axis by about 180 degrees.

6. The apparatus of claim 1, wherein, in the first position, the strap extends over a head rail of the bed frame.

7. The apparatus of claim 1, wherein, in the second position, the strap extends over a siderail of the bed frame.

8. The apparatus of claim 1, further comprising a control panel to operate the motor, the control panel being operable to turn the motor on and off.

9. The apparatus of claim 8, wherein the control panel is operable to control a speed of the motor.

10. The apparatus of claim 8, wherein the control panel is configured to couple to the bed frame.

11. The apparatus of claim 8, wherein the control panel includes foot pedals to control the motor.

12. The apparatus of claim 1, further comprising a locking mechanism to lock the motor housing into one of the first position or the second position.

13. The apparatus of claim 1, wherein the strap includes four coupling mechanisms.

14. The apparatus of claim 13, wherein the four coupling mechanisms are coupled to a side of the bed sheet in the second position.

15. The apparatus of claim 13, wherein two of the four coupling mechanisms are coupled to a head of the bed sheet in the first position.

16. The apparatus of claim 1, wherein the strap includes a base strap joined to the winch and a pair of end straps that interchangeably couple to the base strap, wherein each end strap includes at least one coupling mechanism.

17. The apparatus of claim 16, wherein:

a first end strap of the pair of end straps includes four coupling mechanisms, and a second end strap of the pair of end straps includes two coupling mechanisms.

* * * * *